US007089774B2

(12) United States Patent
Takahashi

(10) Patent No.: US 7,089,774 B2
(45) Date of Patent: Aug. 15, 2006

(54) BENDING DEVICE AND BENDING METHOD

(75) Inventor: Hideaki Takahashi, Isehara (JP)

(73) Assignee: Amada Company, Limited (JP)

( * ) Notice: Subject to any disclaimer, the term of this patent is extended or adjusted under 35 U.S.C. 154(b) by 147 days.

(21) Appl. No.: 10/433,783

(22) PCT Filed: Dec. 5, 2001

(86) PCT No.: PCT/JP01/10633

§ 371 (c)(1),
(2), (4) Date: Jun. 6, 2003

(87) PCT Pub. No.: WO02/45878

PCT Pub. Date: Jun. 13, 2002

(65) Prior Publication Data

US 2004/0055348 A1 Mar. 25, 2004

(30) Foreign Application Priority Data

Dec. 7, 2000 (JP) ..... 2000-372829

(51) Int. Cl.
*B21D 9/08* (2006.01)
*B21D 5/02* (2006.01)
*B30B 15/14* (2006.01)

(52) U.S. Cl. ..... 72/389.3; 72/20.1; 364/474.07

(58) Field of Classification Search ..... 72/389.3, 72/443, 14.8, 20.1; 364/474.07
See application file for complete search history.

(56) References Cited

U.S. PATENT DOCUMENTS 4,797,831 A * 1/1989 Dressing et al. ..... 72/389.3
4,831,862 A * 5/1989 Ohashi et al. ..... 72/389.3
6,874,343 B1 * 4/2005 Ariji ..... 72/20.1

FOREIGN PATENT DOCUMENTS

JP 05-305349 11/1993
JP 05-337555 12/1993
JP 06-106248 4/1994
JP 11-123460 5/1999
JP 11-347634 12/1999

OTHER PUBLICATIONS

International Search Report mailed Mar. 12, 2002.

* cited by examiner

*Primary Examiner*—David B. Jones
(74) *Attorney, Agent, or Firm*—Blank Rome LLP

(57) ABSTRACT

A moving speed of one of tables 11 during the bending process in an approaching direction is controlled to be a bending process optimal speed which is determined by maximum machine speed inherent in the table 11, a coefficient of a material of a workpiece W, a coefficient of a thickness of the workpiece W, a coefficient of a product shape, and coefficients of dies P and D.

8 Claims, 6 Drawing Sheets

FIG.1

| BENDING ORDER | FIRST TIME | SECOND TIM | THIRD TIME |
|---|---|---|---|
| SIDE SHAPE OF BENT WORKPIECE | 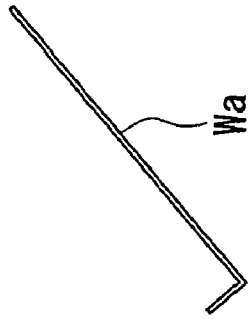  | 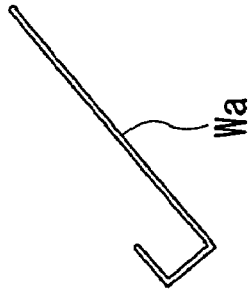  | 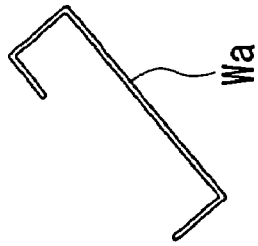  |
| DIES | P 1, D 1 | P 1, D 1 | P 3, D 3 |
| COEFFICIENT | $F_{1m}$, $F_{2t}$, $F_{3d}$, $F_{4s}$ | $F_{1m}$, $F_{2t}$, $F_{3d}$, $F_{4s}$ | $F_{1m}$, $F_{2t}$, $F_{3g}$, $F_{4u}$ |
| Va | $V_{max} \times F_{1m} \times F_{2t} \times F_{3d} \times F_{4s}$ | $V_{max} \times F_{1m} \times F_{2t} \times F_{3d} \times F_{4s}$ | $V_{max} \times F_{1m} \times F_{2t} \times F_{3g} \times F_{4u}$ |
| Vb | $K \times V_{max} \times F_{3d}$ | $K \times V_{max} \times F_{3d}$ | $K \times V_{max} \times F_{3g}$ |
| Vc | $L \times V_{max} \times F_{3d} \times F_{4s}$ | $L \times V_{max} \times F_{3d} \times F_{4s}$ | $L \times V_{max} \times F_{3g} \times F_{4u}$ |

BENDING DEVICE AND BENDING METHOD

TECHNICAL FIELD

The present invention relates to a bending device and a bending method which bends a plate-like workpiece.

BACKGROUND ART

A conventional general bending device includes an upper table and a lower table located below the upper table, and the tables are opposed to each other. The upper table is provided at its lower side with a punch as an upper die. The lower table is provided at its upper side with a die as a lower die. One of the tables, e.g., the lower table moves in the vertical direction (approaching direction and separating direction) in which the lower table approaches and separates from the upper table by operation of a pair of hydraulic cylinders which are separated from each other in the lateral direction. A moving speed of the lower table is set by a depressing degree of foot pedal or by speed data which is input to a control unit such as an NC device.

The plate-like workpiece is supported on the dies, and the lower table is allowed to move in the vertical direction by the operation of the pair of hydraulic cylinders. With this operation, the punch and the die cooperate, and the workpiece can be bent.

During the bending process in which the upper die comes into contact with the workpiece and most approaches the lower die, if the moving speed of the one movable table in the approaching direction is not appropriate, the following problems come up. That is, when a material of the workpiece is soft or a thickness of the workpiece is thin, if the moving speed of the movable table in the approaching direction during the bending process is too fast, coil breaks are generated in the workpiece, which deteriorates the bending precision. When a length of a bending flange is long, if the moving speed of the movable table during the bending process is too fast, a rebounding speed of the bending flange becomes fast, which is not preferable for operation safety. If the moving speed of the movable table during the bending process is too slow, there is a problem that the operation time becomes too long and the productivity is deteriorated.

The present invention has been achieved in order to solve the problems, and it is a first object of the invention to provide a bending device and a bending method capable of automatically determining a moving speed of a ram in accordance with a material of a workpiece, especially a thickness of the workpiece and a length of a flange so as to eliminate coil breaks of the workpiece.

It is a second object of the invention to provide a bending device and a bending method capable of restraining a rebounding speed of a bending flange from increasing and capable of safely bending a workpiece without posing no danger to an operator by automatically determining the moving speed of a ram in accordance with a flange length of the workpiece.

DISCLOSURE OF THE INVENTION

To achieve the above objects, a bending device according to a first aspect of the invention comprising: an input section through which workpiece data including a plate thickness of a workpiece, product data including a length of a flange of a product which is obtained by machining the workpiece are inputted; database in which the various data input through the input section and a coefficient for determining a ram speed correspond to each other; and a ram speed computing section which computes and determines the ram speed based on the various data input through the input section and the database.

A second aspect of the invention provides the bending device according to the first aspect, wherein the data input through the input section includes machine data having a width of a V groove of a lower die.

A third aspect of the invention provides the bending device according to the first or second aspect, wherein the workpiece data includes a material of the workpiece.

A fourth aspect of the invention provides the bending device according to any one of the first to third aspects, wherein the ram speed computing section computes and determines the ram speed by multiplying a maximum speed of the ram of the bending device or a reference speed of a set speed by the coefficient of the database.

A fifth aspect of the invention provides the bending device according to any one of the first to fourth aspects, wherein the ram speed computing section computes and determines the ram speed based on a width of a V groove of the lower die input through the input section, a length of a flange of a product, a plate thickness of the workpiece and the coefficient of the database.

A sixth aspect of the invention provides the bending device according to any one of the first to fifth aspects, wherein the coefficient of the database is set large when the workpiece is hard; the coefficient of the database is set small when the workpiece is soft; the coefficient of the database is set large when the workpiece is thick; and the coefficient of the database is set small when the workpiece is thin.

A seventh aspect of the invention provides the bending device according to the first to sixth aspects, wherein the coefficient of the database is set small when the a length of a bending flange of the bent product is long; and the coefficient of the database is set large when the a length of a bending flange of the bent product is short.

An eighth aspect of the invention provides the bending device according to any one of the first to seventh aspects, wherein the coefficient of the database is set small when a width of a V groove of the lower die is small; and the coefficient of the database is set large when the width of the V groove of the lower die is large.

A bending device according to a ninth aspect of the invention is for bending a plate-like workpiece, comprising: an upper table provided at its lower side with an upper die; a lower table located below the upper table and provided at its upper side with a lower die, the upper table and lower table being opposed to each other; an actuator which moves one of the upper table and the lower table in an approaching direction and a separating direction in which the one table approaches and separates from the other table, respectively; actuator control means which controls the actuator such that a moving speed of the one table in the approaching direction during a bending process becomes equal to a bending process optimal speed which is determined by a maximum machine speed inherent in the one table, a coefficient of a material of a workpiece, a coefficient of a thickness of the workpiece, a coefficient of a product shape and a coefficient of a die.

A tenth aspect of the invention provides the bending device according to the ninth aspect, wherein the coefficient of the material of the workpiece is set large when the workpiece is hard; the coefficient of the material of the workpiece is set small when the workpiece is soft; the coefficient of the thickness of the workpiece is set large when the workpiece is thick; the coefficient of the thickness of the workpiece is set small when the workpiece is thin; the coefficient of the product shape is set large when a bending flange is short; the coefficient of the product shape is set small when a bending flange is long; the coefficient of the die is set large when a V width and a shoulder R of the die are large; and the coefficient of the die is set small when a V width and a shoulder R of the die are small.

A bending method according to an eleventh aspect of the invention comprises the following steps: a step for determining, as a bending process optimal speed, a moving speed of one of an upper table having an upper die and a lower table having a lower die in directions in which the one table approaches and separates from the other table, by means of a maximum machine speed inherent in the one table, a coefficient of a material of a workpiece, a coefficient of a thickness of the workpiece, a coefficient of a product shape and a coefficient of the die; and a step for moving the one table in the directions in which the one table approaches and separates from the other table at the determined bending process optimal speed, thereby bending a plate-like workpiece.

A twelfth aspect of the invention provides the bending method according to the eleventh aspect, wherein a moving speed of the one table in the approaching direction during a bending process when to-be-worked portions are bent is a bending process optimal speed which is determined by the maximum machine speed inherent in the one table, the coefficient of the material of the workpiece, the coefficient of the thickness of the workpiece, the coefficient of the product shape and the coefficient of the die.

A thirteenth aspect of the invention provides the bending method according to the eleventh or twelfth aspect, wherein the coefficient of the material of the workpiece is set large when the workpiece is hard; the coefficient of the material of the workpiece is set small when the workpiece is soft; the coefficient of the thickness of the workpiece is set large when the workpiece is thick; the coefficient of the thickness of the workpiece is set small when the workpiece is thin; the coefficient of the product shape is set large when a bending flange is short; the coefficient of the product shape is set small when a bending flange is long; the coefficient of the die is set large when a V width and a shoulder R of the die are large; and the coefficient of the die is set small when a V width and a shoulder R of the die are small.

A fourteenth aspect of the invention provides the bending method according to any one of the eleventh to thirteenth aspects, wherein a moving speed of the one table in the approaching direction during an approaching process is an approaching process optimal speed which is determined by a maximum machine speed of the one table and a coefficient of a product shape; and a moving speed of the one table in the separating direction during a returning process is a returning process optimal speed which is determined by the maximum machine speed of the one table, a coefficient of the product shape and a coefficient of the die.

Therefore, according to the above invention, by moving the one table with respect to the other table in directions (approaching direction, separating direction) in which the one table approaches and separates from the other table, the plate-like workpiece is bent. During the bending process, the moving speed of the one table becomes the bending process optimal speed by the actuator control means.

In other words, according to the invention, the moving speed of the one table in the approaching direction during a bending process becomes equal to a bending process optimal speed which is determined by a maximum machine speed inherent in the one table, a coefficient of a material of a workpiece, a coefficient of a thickness of the workpiece, a coefficient of a product shape and a coefficient of a die. Therefore, the moving speed of the one table is increased as fast as possible to enhance the productivity, coil breaks of the workpiece are eliminated to enhance the bending precision. The rebounding speed of the bending flange is restrained from becoming fast, and safety of the operation can be secured.

Further, the moving speed of the one table in the approaching direction during an approaching process is an approaching process optimal speed which is determined by the maximum machine speed of the one table and the coefficient of the product shape, and the moving speed of the one table in the separating direction during the returning process is the returning process optimal speed which is determined by the maximum machine speed of the one table, the coefficient of the product shape and the coefficient of the die. Therefore, the above effect is further enhanced.

BRIEF DESCRIPTION OF THE DRAWINGS

FIG. 1 is an explanatory view of a bending order, selected die and optimal speed.

BEST MODE FOR CARRYING OUT THE INVENTION

An embodiment of the present invention will be explained below with reference to the drawings.

Figure 8:
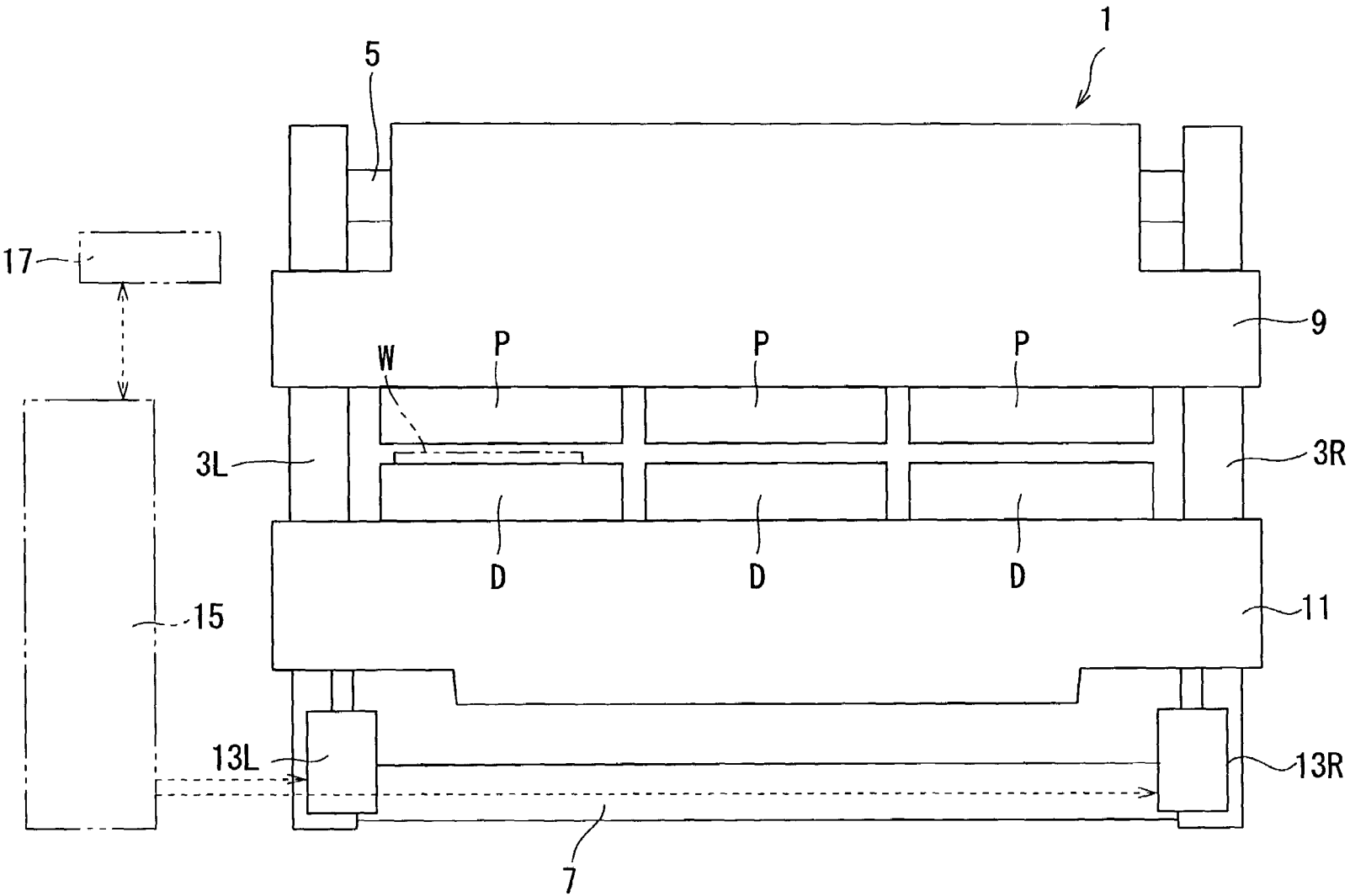
FIG. 8 is a front view of a bending device.

As shown in FIG. 8, a bending device 1 according to an embodiment of the present invention is based on a pair of side frame 3L and 3R which are laterally separated from each other in FIG. 8. The pair of side frame 3L and 3R are connected to each other through an upper connecting member 5 and a lower connecting member 7. An upper table 9 laterally extends between upper portions (upper portions in FIG. 8) of the side frame 3L and 3R. A lower table 11 laterally extends between lower portions of the side frame 3L and 3R. The lower table 11 is opposed to the upper table 9.

The lower side of the upper table 9 is provided with a plurality of punches P as upper dies. The punches P are attachable and detachable with respect to the lower side. The punches P are arranged in the lateral direction at appropriate distances from one another. The upper side of the lower table 11 is provided with a plurality of dies D as lower dies. The dies D are attachable and detachable with respect to the lower side. The dies D are arranged in the lateral direction at appropriate distances from one another. Since the plurality of punches P and dies D are provided, a plurality of to-be-worked portions of the workpiece can be bent in a bending order. It is also possible to provide the lower side of the upper table 9 with the dies D as upper dies and to provide the upper side of the lower table 11 with the punches P as lower dies.

The upper table 9 can move vertically with respect to the side frame 3L and 3R through a guide member (not shown). The side frame 3L and 3R are respectively provided with hydraulic cylinders 13L and 13R for moving the lower table 11 in the vertical direction. Instead of vertically moving the lower table 11, it is also possible to vertically move the upper table 9.

Figure 2:
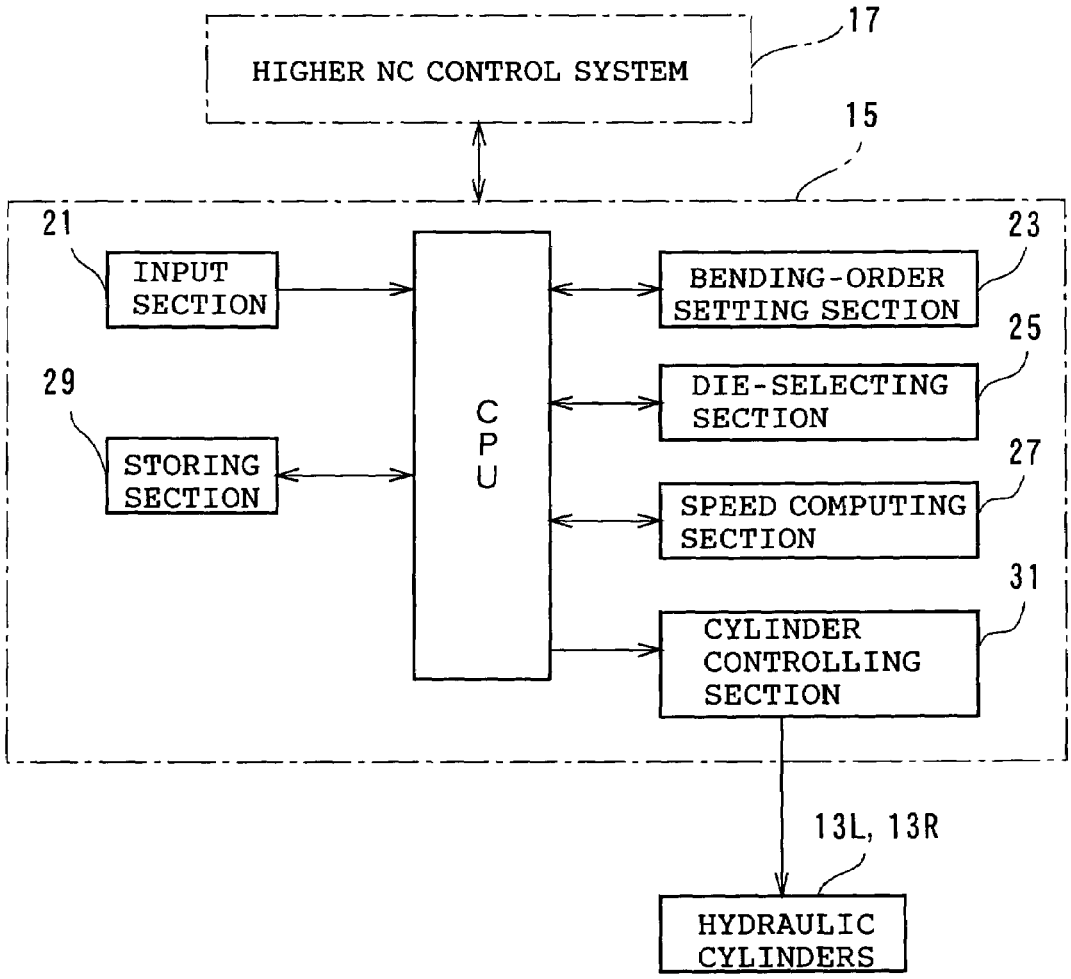
FIG. 2 shows an NC control system.

The bending device according to the embodiment of the present invention includes an NC control system 15 as shown in FIG. 2. The NC control system 15 is electrically connected to a higher NC control system 17. The NC control system 15 includes a CPU 19, an input section 21 such as a keyboard, a bending-order setting section 23, a die-selecting section 25, a speed computing section 27, a storing section 29 and a cylinder controlling section 31. The cylinder controlling section 31 is electrically connected to the hydraulic cylinders 13L and 13R. More specifically, the cylinder controlling section 31 is connected to flow rate adjusting means (flow rate adjusting valve) which is included in the hydraulic cylinders 13L and 13R and which adjusts the flow rate of hydraulic fluid. The bending-order setting section 23, the die-selecting section 25 and the speed computing section 27 may be accommodated in the higher NC control system 17.

The NC control system 15 can receive bending conditions comprising machine data, workpiece data and product data from the higher NC control system 17.

Figure 7:
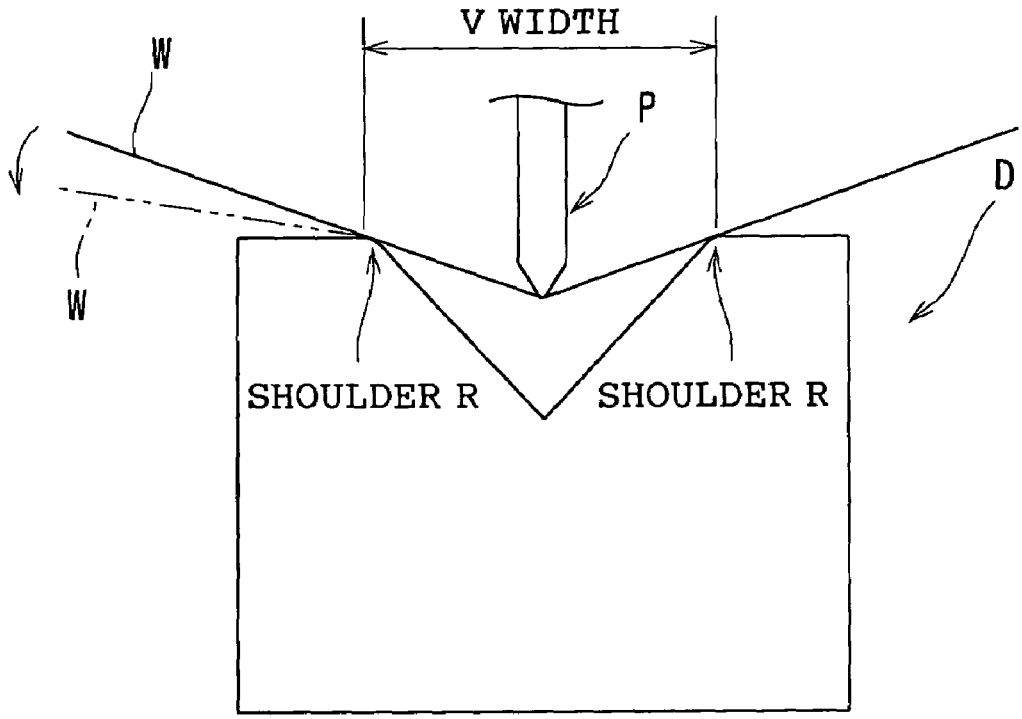
FIG. 7 shows dies.

The machine data includes maximum machine speed Vmax inherent in the lower table 11, a V width, a shoulder R and the like of the die D as shown in FIG. 7. The maximum machine speed Vmax is an upper limit machine speed based on characteristics and performance of the lower table 11, the hydraulic cylinders 13L and 13R, the flow rate adjusting means (flow rate adjusting valve) which adjust the flow rate of hydraulic fluid, the cylinder controlling section 31 and the like.

More specifically, the machine data includes a reference speed of the lower table 11. The reference speed includes the maximum machine speed Vmax and a set speed.

The workpiece data includes a material of the workpiece W, a thickness of the workpiece W and the like. The product data includes a length of a bending flange Wa (see FIG. 1), a development of a product, a stereoscopic view of the product and the like. The bending flange Wa is a piece formed by the bending operation, and is located closer to an operator side or opposite side (opposite side from the operator) with respect to the dies P and D.

Appropriate data is input through the input section 21. The bending condition may directly be input to the input section 21, instead of receiving the bending condition from the higher NC control system 17.

The bending-order setting section 23 sets a bending order when a plurality of to-be-worked portions of the plate-like workpiece W are bent by executing a bending-setting program based on the bending condition. By executing a die-selecting program based on the bending condition, die-selecting section 25 selects punches P and dies D used when the to-be-worked portions are bent.

The speed computing section 27 computes a bending process optimal speed Va during the bending process when the to-be-worked portions of the workpiece W are bent. Here, the bending process is a process from an instant when a tip end of the punch P comes into contact with the workpiece W (bending operation is started) to an instant when the punch P and the die D most approach each other (bending operation is completed). The bending process optimal speed Va is computed as many times as the number of to-be-worked portions. The bending process optimal speed Va can be expressed as follows:

$$Va = V\max \times F1 \times F2 \times F3 \times F4$$

Figure 3:
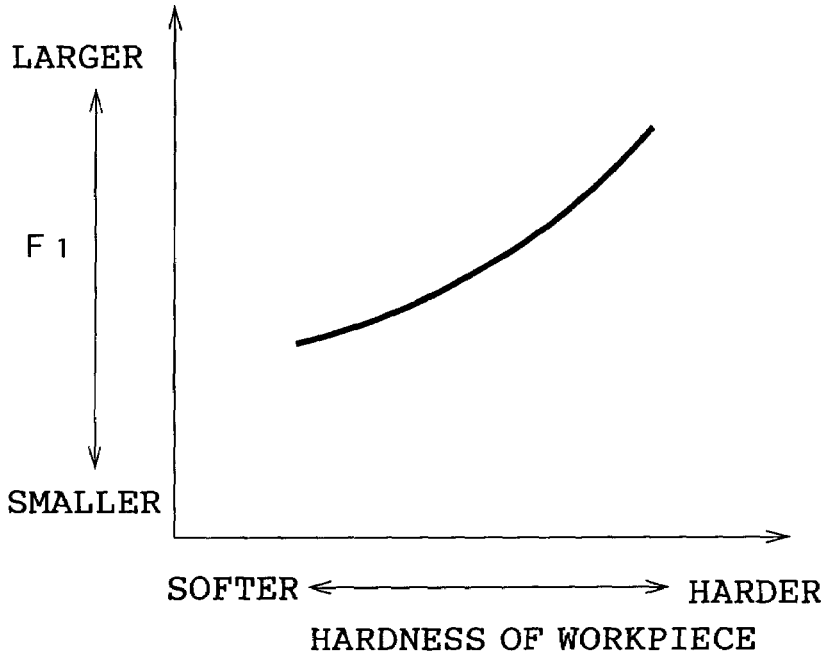
FIG. 3 shows a relation between a coefficient of a material of a workpiece and a hardness of the workpiece.
Figure 4:
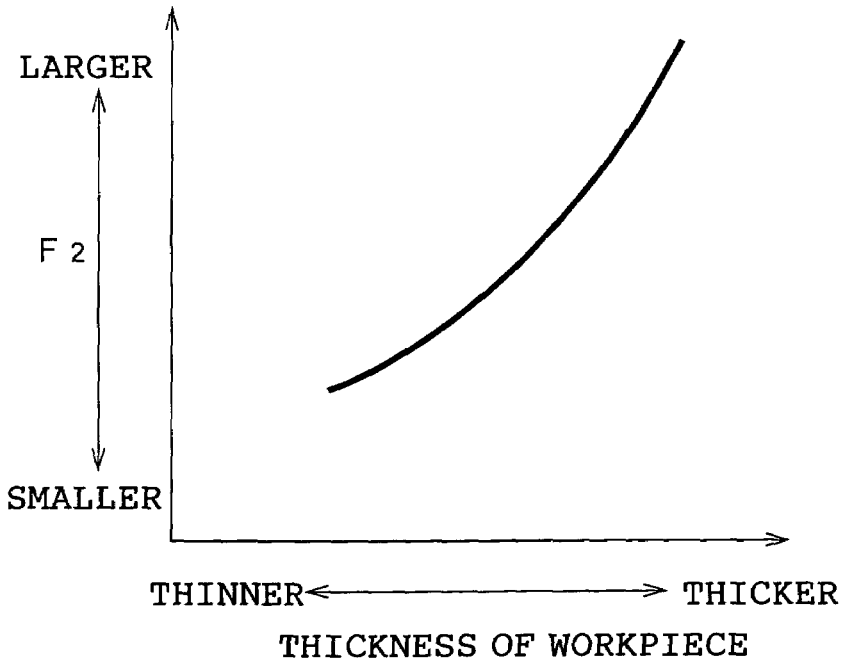
FIG. 4 shows a relation between a coefficient of a thickness of the workpiece and the thickness of the workpiece.
Figure 5:
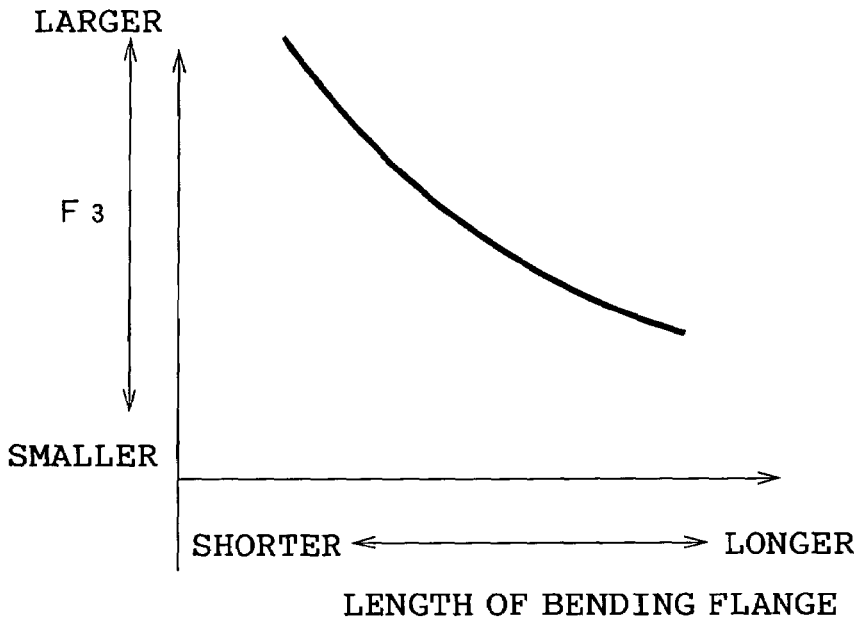
FIG. 5 shows a relation between a coefficient of a product shape and a length of a bending flange.
Figure 6:
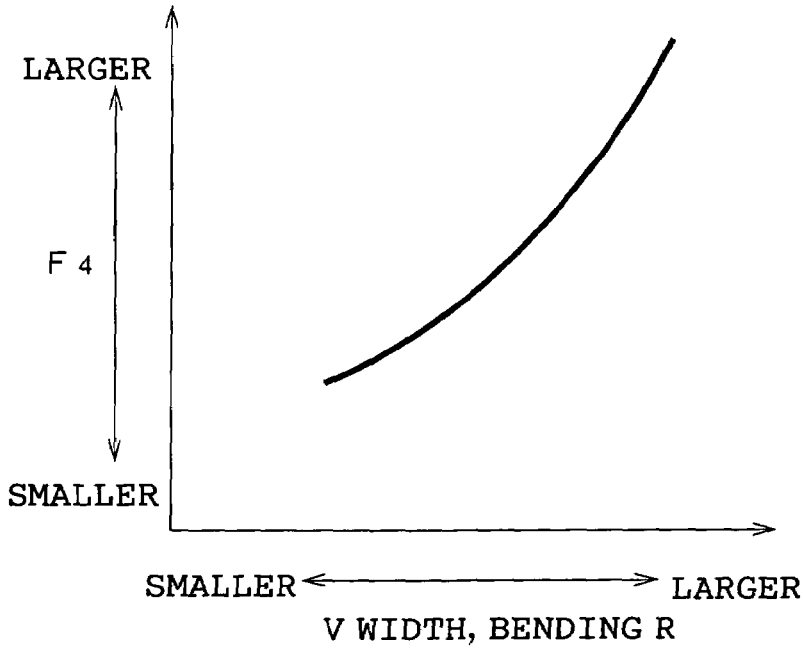
FIG. 6 shows a relation between a coefficient of a die and V width and bending R.

Here, F1 is a coefficient of a material of the workpiece W. As shown in FIG. 3, the coefficient is large when the material of the workpiece W is hard and the coefficient is small when the material of the workpiece W is soft. F2 is a coefficient of a thickness of the workpiece W. As shown in FIG. 4, the coefficient is large when the workpiece W is thick and the coefficient is small when the workpiece W is thin. F3 is a coefficient of a product shape. As shown in FIG. 5, the coefficient is large when the bending flange Wa is short, and the coefficient is small when the bending flange Wa is long. F4 is a coefficient of dies P and D. As shown in FIG. 7, the coefficient is large when the V width and the shoulder R of the die D are large, and the coefficient is small when the V width and the shoulder R of the die D are small.

Here, F3 and F4 can also be set to appropriate coefficients such that a speed of a tip end (or barycenter of the bending flange Wa) of the bending flange Wa of the workpiece W does not exceed a predetermined threshold value. It is preferable that F3 is corrected when the barycenter of the workpiece W is closer to the tip end.

When the workpiece W is bent based on the predetermined threshold value of the bending process optimal speed Va, the workpiece W is rotated in a state shown with a solid line in FIG. 7, and is bent. However, when the workpiece W is bent in a state in which the bending process optimal speed Va exceeds the predetermined threshold value, the workpiece W is bent in a state shown with a phantom line in FIG. 7. This is because since the rotation speed of the workpiece W in the upward direction becomes abnormally high, the workpiece W tries to maintain its state before being bent by an inertial force and thus, the workpiece W is bent in a state shown with the phantom line. This state is called coil breaks. In this state, the bending precision is deteriorated.

The coil breaks are prone to be generated when the length of the flange Wa (flange length) shown in FIG. 1 is long. Even when the length of the flange Wa is short, if the workpiece W is bent as shown in the third time in FIG. 1, the tip end of the flange Wa is bent un a form of U-shape and is heavy, and if the barycenter is located near the tip end of the flange Wa, the coil breaks are prone to be generated. Further, when the workpiece W is thin or when the material of the workpiece W is soft, the coil breaks are prone to be generated.

In view of the above circumstances, in this invention, the bending operation is carried out while changing the coefficients and controlling the bending process optimal speed Va to the predetermined threshold value in accordance with the length of the flange Wa, thickness and material of the workpiece W and in accordance with whether the barycenter of the flange Wa is near the tip end of the flange Wa.

The speed computing section 27 computes, in addition to the bending process optimal speed Va, an approaching process optimal speed Vb during the approaching process when the to-be-worked portions of the workpiece W are bent. The approaching process is a process carried out from an instant when upward movement of the lower table 11 is started to an instant when the tip end of the punch P comes into contact with the workpiece W. The approaching process optimal speed Vb is computed as many times as the number of to-be-worked portions. The approaching process optimal speed Vb can be expressed as follows:

$$Vb = K \times V\max \times F3$$

Here, K is a predetermined coefficient when the approaching process optimal speed Vb is computed, and F3 is a coefficient of the product shape as described above, but here, a length of the workpiece Wa is not taken into consideration, and F3 is an appropriate coefficient which is taken into consideration when a long side of the workpiece is bent after a short side of the workpiece is bent.

The speed computing section 27 computes, in addition to the bending process optimal speed Va and the approaching process optimal speed Vb, a returning process optimal speed Vc during a returning process when the to-be-worked portions of the workpiece W are bent. Here, the returning process is a process carried out from an instant when the punch P most approach the die D to an instant when the lower table 11 downwardly moves. The returning process optimal speed Vc is computed as many times as the number of to-be-worked portions. The returning process optimal speed Vc can be expressed as follows:

$$Vc=L\times V\max\times F3\times F4$$

Here, L is a predetermined coefficient when the returning process optimal speed Vc is computed, and F3 and F4 are a coefficient of the product shape and a coefficient of the die when the bending process optimal speed is computed.

As explained above, the maximum machine speed Vmax is a numeric value used whenever the bending process optimal speed Va, the approaching process optimal speed Vb and the returning process optimal speed Vc are computed as shown in FIG. 1. The maximum machine speed Vmax is multiplied by the above-described coefficient, and the bending process optimal speed Va, the approaching process optimal speed Vb and the returning process optimal speed Vc for the first bending operation are computed. Next, the bending process optimal speed Va, the approaching process optimal speed Vb and the returning process optimal speed Vc for the second bending operation are computed. Then, the bending process optimal speed Va, the approaching process optimal speed Vb and the returning process optimal speed Vc for the third bending operation are computed. Therefore, in the case of the bending operations shown in FIG. 1, total nine computations are carried out, and the lower table 11 is vertically moved and the bending operation is carried out based on the bending process optimal speed Va, the approaching process optimal speed Vb and the returning process optimal speed Vc which are determined by the computations.

The storing section 29 stores various data such as the bending condition received from the higher NC control system 17, the bending order which is set by the bending-order setting section 23, the dies P and D which are selected by the die-selecting section 25, the optimal speeds Va, Vb and Vc which are computed by the speed computing section 27, and the like.

The cylinder controlling section 31 controls the pair of hydraulic cylinders 13L and 13R such that the upward moving speed of the lower table 11 becomes the approaching process optimal speed Va during the approaching process, and the upward moving speed of the lower table 11 becomes the bending process optimal speed Vb during the bending process. Further, the cylinder controlling section 31 controls the pair of hydraulic cylinders 13L and 13R such that the downward moving speed (returning speed) of the lower table 11 becomes the returning process optimal speed Vc.

Next, a bending method of an embodiment of the present invention including its operation will be explained.

The NC control system 15 receives the bending condition from the higher NC control system 17, and executes the bending order program based on the bending condition by the bending-order setting section 23. With this operation, the bending order when a plurality of (e.g., three) to-be-worked portions of the workpiece W are bent is set as shown in FIG. 4. By executing the die-selecting program based on the bending condition by the die-selecting section 25, dies (P1, D1), (P1, D1), (P3, D3) used when the three to-be-worked portions are bent, in accordance with the bending order are selected.

After the setting of the bending order and selection of the dies P and D are completed, optimal moving speeds Va, Vb and Vc of the lower table 11 when the three to-be-worked portions are bent are in accordance with the bending order computed by the speed computing section 27. Here, if a coefficient of the material of the workpiece W is F1*m*, a coefficient of the thickness of the workpiece W is F2*t*, and coefficients of the product shape when the three to-be-worked portions are bent in accordance with the bending order are F3*d*, F3*d* and F3*g*, and coefficients of the dies P and D used when the three to-be-worked portions are bent in accordance with the bending order are F4*s*, F4*s* and F4*u*, the optimal speeds are as follows:

That is, the optimal moving speeds Va, Vb and Vc of the lower table 11 when the first bending operation is carried out are:

the bending process optimal moving speed $$Va=V\max\times F1m\times F2t\times F3d\times F4s$$

the approaching process optimal moving speed $$Vb=K\times V\max\times F3d$$

the returning process optimal speed $$Vc=L\times V\max\times F3d\times F4s.$$

The optimal moving speeds Va, Vb and Vc of the lower table 11 when the second bending operation is carried out are:

the bending process optimal moving speed $$Va=V\max\times F1m\times F2t\times F3d\times F4s$$

the approaching process optimal moving speed $$Vb=K\times V\max\times F3d$$

the returning process optimal speed $$Vc=L\times V\max\times F3d\times F4s.$$

The optimal moving speeds Va, Vb and Vc of the lower table 11 when the third bending operation is carried out are:

the bending process optimal moving speed $$Va=V\max\times F1m\times F2t\times F3g\times F4u$$

the approaching process optimal moving speed $$Vb=K\times V\max\times F3g$$

the returning process optimal speed $$Vc=L\times V\max\times F3g\times F4u.$$

After the optimal moving speeds Va, Vb and Vc are computed by the speed computing section 27, positioning of the workpiece W with respect to the dies P and D is appropriately carried out, and the lower table 11 is reciprocated three times in the vertical direction in which the lower table 11 approaches and separates from the upper table 9. With this operation, three to-be-worked portions of the workpiece W can be bent continuously in bending order. Here, the upward moving speeds of the lower table 11 during the approaching process and the bending process when the to-be-worked portions are bent are controlled to the approaching process optimal moving speed Vb and the bending process optimal moving speed Va, and the downward moving speed of the lower table 11 during the returning process is controlled to the returning process optimal speed Vc.

As described above, according to the embodiment of the present invention, the upward moving speeds of the lower table 11 during the approaching process and the bending process when the to-be-worked portions are bent are controlled to the approaching process optimal moving speed Vb and the bending process optimal moving speed Va, and the downward moving speed of the lower table 11 during the returning process is controlled to the returning process optimal speed Vc. Therefore, the moving speed of the lower table 11 is increased as fast as possible to enhance the productivity, coil breaks of the workpiece W are eliminated to enhance the bending precision. The rebounding speed of the bending flange Wa is restrained from becoming fast, and safety of the operation can be secured.

The safety will be explained in detail. When the workpiece W is bent, the bending operation proceeds while rotating the flange Wa upward. Therefore, the tip end of the flange Wa also bounces upward. Thus, even if the workpiece W is bent at the same bending speed (bending speed at which flange Wa rotates at the same speed), when a workpiece W having a long flange Wa is bent, the rebounding speed of the tip end of the flange Wa, i.e., of a portion thereof closer to an operator is amplified and the speed becomes extremely fast. For this reason, it is necessary to reduce the rebounding speed to such a degree that the operator can avoid interference with the bouncing tip end of the flange Wa. Therefore, in order to reduce the bending speed of the workpiece W, it is necessary to reduce the bending process optimal speed Va. In this invention, the bending process optimal speed Va is adjusted while taking the flange Wa of the workpiece W into consideration, and when the flange Wa is long, the bending process optimal speed Va is reduced. Therefore, it is possible to restrain the rebounding speed of the bending flange Wa from becoming fast, and to secure the safety of operation.

The invention claimed is:

1. A bending device comprising an input section through which workpiece data including a plate thickness of a workpiece, product data including a length of a flange of a product which is obtained by machining the workpiece are inputted;

database of data input through the input section and a corresponding coefficient for determining a ram speed;

a ram speed computing section which computes and determines the ram speed based on data input through the input section and the database;

the data input through the input section includes machine data having a width of a V groove of a lower die; and wherein the ram speed computing section computes and determines the ram speed by multiplying the coefficient of the database by either a maximum speed of the ram of the bending device or of a reference speed of a set speed.

2. A bending device according to claim 1, wherein the ram speed computing section computes and determines the ram speed based on a width of a V groove of the lower die input through the input section, a length of a flange of a product, a plate thickness of the workpiece and the coefficient of the database.

3. A bending device according to claim 2, wherein the coefficient of the database is set large when the workpiece is hard;

the coefficient of the database is set small when the workpiece is soft;

the coefficient of the database is set large when the workpiece is thick; and the coefficient of the database is set small when the workpiece is thin.

4. A bending device according to claim 3, wherein the coefficient of the database is set small when the a length of a bending flange of the bent product is long; and the coefficient of the database is set large when the a length of a bending flange of the bent product is short.

5. A bending device according to claim 4, wherein the coefficient of the database is set small when a width of a V groove of the lower die is small; and the coefficient of the database is set large when the width of the V groove of the lower die is large.

6. A bending device comprising an upper table provided at a lower side with an upper die;

a lower table located below the upper table and provided at an upper side with a lower die, the upper table and lower table being opposed to each other;

an actuator which moves one of the upper table and the lower table in an approaching direction and a separating direction in which the one table approaches and separates from the other table, respectively;

actuator control means which controls the actuator such that a moving speed of the one table in an approaching direction during a bending process becomes equal to a bending process optimal speed which is determined by a maximum machine speed of the one table, a coefficient of a material of a workpiece, a coefficient of a thickness of the workpiece, a coefficient of a product shape and a coefficient of a die; and the coefficient of the material of the workpiece is set large when the workpiece is hard;

the coefficient of the material of the workpiece is set small when the workpiece is soft;

the coefficient of the thickness of the workpiece is set large when the workpiece is thick;

the coefficient of the thickness of the workpiece is set small when the workpiece is thin;

the coefficient of the product shape is set large when a bending flange is short;

the coefficient of the product shape is set small when a bending flange is long;

the coefficient of the die is set large when a V width and a shoulder R of the die are large; and the coefficient of the die is set small when a V width and a shoulder R of the die are small.

7. A bending method for use with a movable upper table having an upper die and a movable lower table having a lower die, the upper table and the lower table movable in directions such that one table approaches and separates from the other table, each said table having characteristics which establish a maximum machine speed of each said table, the method comprising the steps of:

determining a bending process optimal speed of one of the upper table or lower table using a maximum machine speed of said upper table or lower table, a coefficient of a material of a workpiece, a coefficient of a thickness of the workpiece, a coefficient of a product shape and a coefficient of the die;

moving the one table in the direction in which the one table approaches and separates from the other table at the determined bending process optimal speed, the one table having a moving speed in the approaching direction during the bending process, determining the moving speed using the maximum machine speed of the one table, the coefficient of the material of the workpiece, the coefficient of the thickness of the workpiece, the coefficient of the product shape and the coefficient of the die, thereby determining a bending process optimal speed for portions of a workpiece to be bent; wherein the coefficient of the material of the workpiece is set large when the workpiece is hard;

the coefficient of the material of the workpiece is set small when the workpiece is soft;

the coefficient of the thickness of the workpiece is set large when the workpiece is thick;

the coefficient of the thickness of the workpiece is set small when the workpiece is thin;

the coefficient of the product shape is set large when a bending flange is short;

the coefficient of the product shape is set small when a bending flange is long;

the coefficient of the die is set large when a V width and a shoulder R of the die are large; and the coefficient of the die is set small when a V width and a shoulder R of the die are small.

8. A bending method according to claim 7, wherein a moving speed of the one table in the approaching direction during an approaching process is an approaching process optimal speed which is determined by a maximum machine speed of the one table and a coefficient of a product shape; and a moving speed of the one table in the separating direction during a returning process is a returning process optimal speed which is determined by the maximum machine speed of the one table, a coefficient of the product shape and a coefficient of the die.

* * * * *